United States Patent [19]

Peterson et al.

[11] 4,127,756

[45] Nov. 28, 1978

[54] ORGAN STOP TABLET MECHANISM

[76] Inventors: Richard H. Peterson, 11748 Walnut Ridge Dr., Palos Park, Ill. 60464; Antal Szegedi, R.R. #2, Box 65, Lockport, Ill. 60441

[21] Appl. No.: 810,133

[22] Filed: Jun. 27, 1977

[51] Int. Cl.[2] ..... G10B 3/10

[52] U.S. Cl. ..... 200/153 K; 200/339; 84/343; 84/369

[58] Field of Search ..... 84/345, 343, 227, 369, 84/434, 435, DIG. 7; 200/153 K, 339

[56] References Cited

U.S. PATENT DOCUMENTS 4,019,418 4/1977 Kimble ..... 84/343

*Primary Examiner*—L. T. Hix
*Assistant Examiner*—S. D. Schreyer
*Attorney, Agent, or Firm*—Spencer E. Olson

[57] ABSTRACT

A stop tablet mechanism particularly suited for electric organs wherein a plurality of stop tablets lie in closely spaced apart side-by-side relation, the stop tablets being pivotally supported on a tablet rail and spring-biased to assume a neutral position from which they can be momentarily moved up or down against the action of the spring.

5 Claims, 4 Drawing Figures

ORGAN STOP TABLET MECHANISM

BACKGROUND OF THE INVENTION

This invention relates to tablet type switching devices, and particularly to stop tablet mechanisms for use in electric organs wherein a number of stop tablets are arranged in side-by-side relation for convenient actuation by the organist.

Stop tablet mechanisms are known wherein springs of various types are utilized to suspend or cradle the tablets for movement to their alternate positions of use, usually from a normal "up" position to an operated "down" position. A form of spring in common use is one that provides an over center snap as the tablet is displaced from either of the two positions, and the ultimate "up" and "down" positions of the tablet are determined by engagement of the tablet with the upper and lower edges, respectively, of a narrow slot in the organ console through which the tablets project. In mechanisms of this type, displacement of the activated tablets from their normal rest position provides an indication to the organist of which stops are on. An objection to such mechanisms is that the felt with which the edges of the slot is usually lined to reduce noise caused by the snap action of the tablets is subject to uneven wear and/or compression as between frequently used and little used tablets, with the result their positions in the normal and operated positions may vary from tablet to tablet and detract from the appearance of the organ.

In an application filed concurrently herewith by Richard H. Peterson and Richard W. Jensen entitled, "Indicating Organ Stop Tablet", Ser. No. 810,136 there is described a stop tablet control system in which the "on" condition of selected stops is indicated by an illuminated light emitting diode mounted in each stop tablet, the energization of which is controlled by latching circuit means operative in response to momentary depression of a stop tablet from a neutral position. When the tablet is momentarily pushed up from the neutral position, the associated stop is turned "off" and the light emitting diode is extinguished. Thus, instead of employing springs of the type that have long been used in organ stop tablet mechanisms which provide an over center "snap" as the tablet is displaced from its normal position to the operated position, the tablets are spring-biased to assume a neutral position from which they can be momentarily moved up or down against the action of the spring.

It is a primary object of the present invention to provide a stop tablet mechanism that is easy to manufacture and adjust, which maintains the tablets in a preset neutral position with relative firmness, and wherein the tablets can be momentarily moved up or down against the action of a spring and returned to the pre-set neutral position.

SUMMARY OF THE INVENTION

In accordance with the present invention, any desired number of stop tablets may be pivotally supported on a common tablet rail which, in turn, is supported on a one-piece mounting bracket constructed to permit close center spacing of the tablets. The tablets themselves are of essentially one-piece construction and may be molded from plastic material, and may be of different colors, if desired. The tablets are provided with a transverse groove engageable with the tablet rail, each tablet being urged upwardly by a vertically-oriented flat spring secured at its lower end to the mounting bracket, and having a curved upper end that conforms essentially to a curved portion of the underside of the stop tablet. The springs are configured to coact with the curved underside of the tablet so as to be deflected in the same direction from its normal vertical position whether the tablet is moved upwardly or downwardly, and to return and maintain the tablet in its neutral position.

DESCRIPTION OF THE PREFERRED EMBODIMENT

Figure 1:
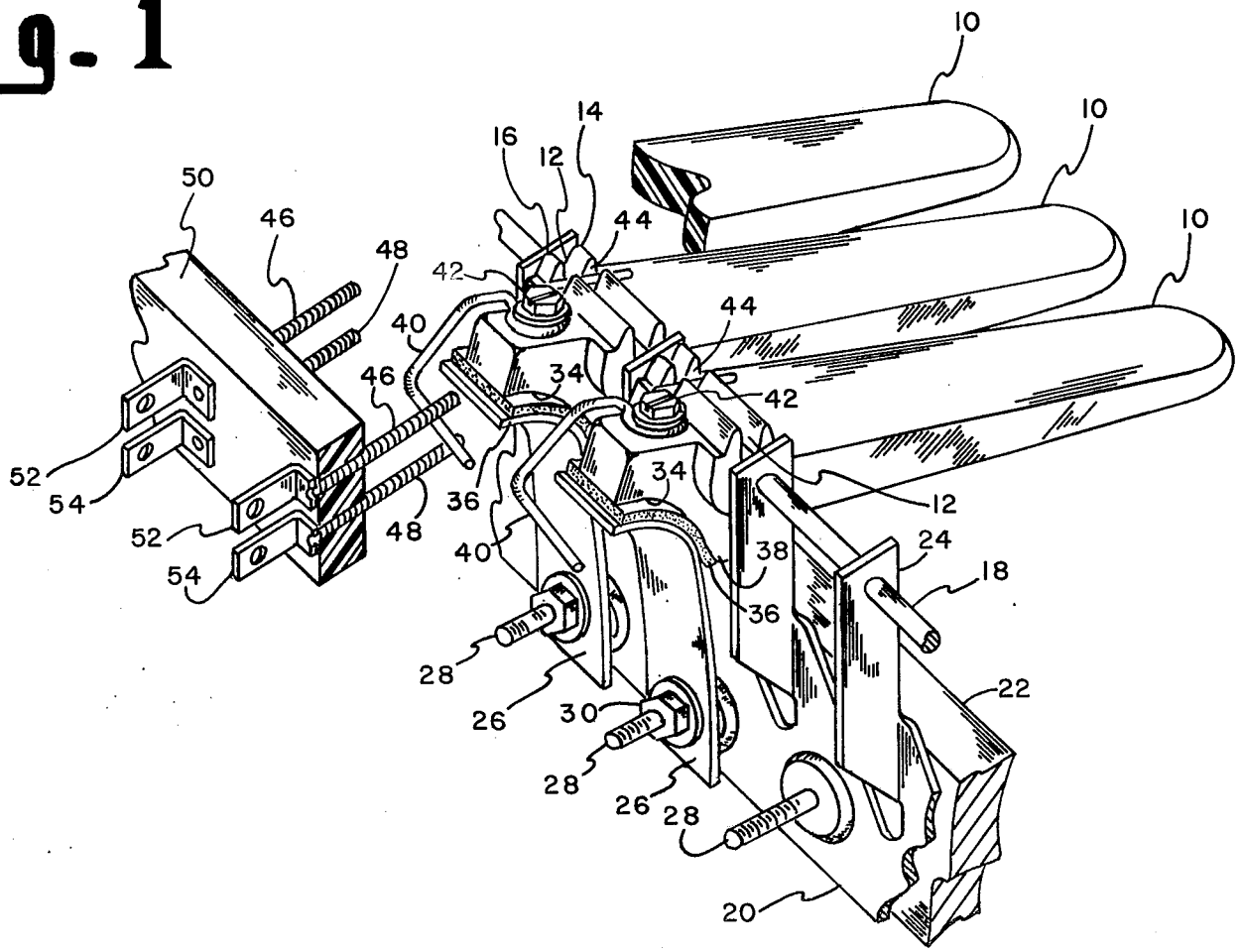
FIG. 1 is a fragmentary perspective view of the stop tablet mechanism with parts broken away.
Figures 2, 3, 4:
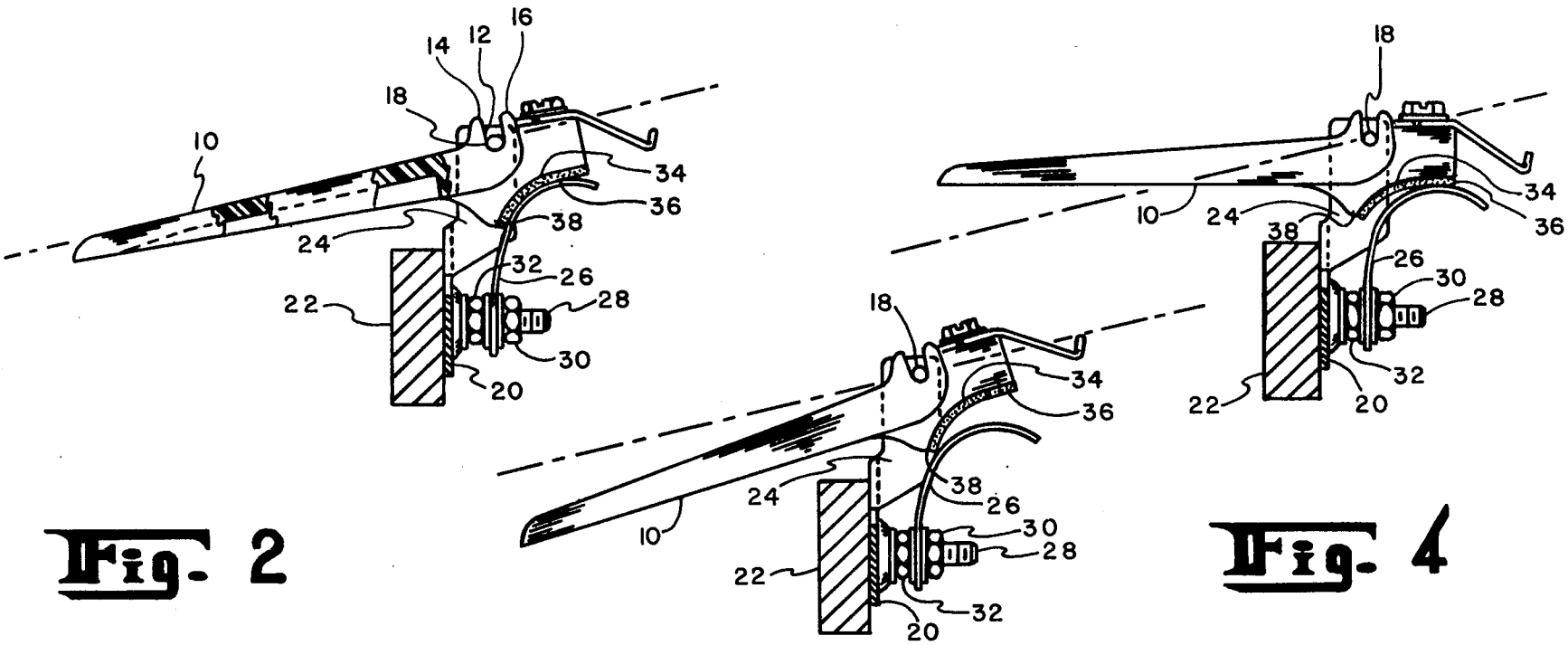
FIG. 2 is a side elevation view, partly in section, showing one tablet of the organ stop tablet mechanism in its neutral position.
FIGS. 3 and 4 are fragmentary side elevational views respectively showing a tablet moved downwardly and upwardly from its neutral position.

Referring first to FIG. 1, the organ stop tablet mechanism in accordance with the invention includes a plurality of stop tablets 10, two of which are illustrated, arranged in side-by-side relation. The stop tablets are preferably molded from plastic material, and have a cross-section as indicated in FIG. 2. Typically, the tablets have an overall length of about 3 ¾ inches and a width of about ¾ inch, and may be the kind that Gulbransen has used on its organs for several years. Each tablet has a transverse groove 12 therein defined by a pair of upstanding lips 14 and 16 having a depth of about ¼ inch, for receiving a tablet rail 18 which, in turn, is supported on a mounting bracket 20 secured to the cabinet 22 of the organ. The mounting bracket may be of one-piece construction and has a plurality of flanges 24 disposed perpendicular to the axis of the rail 18 and parallel to each other spaced apart a distance so as to receive with clearance a stop tablet between adjacent brackets. Although the rail 18 is shown as being straight, mounting bracket 20 and rail 18 may be constructed of sufficiently flexible material as to permit shaping the mechanism into a horseshoe configuration, as is typical on many organ consoles.

Each of the stop tablets 10 is urged upwardly, to force the bottom of the groove 12 into engagement with rail 18, by a flat spring 26 secured near its lower end to the mounting bracket 20 (and thus to the cabinet 22 of the organ) by a suitable fastener, such as a threaded stud 28 and a nut 30 threadedly engaging the stud, positioned between adjacent brackets. As best seen in the side elevation views of FIGS. 2–4, the lower end of spring 26 is spaced from the bracket 20 by a spacer nut 32, secured to stud 28, of a thickness such that that portion of the spring 26 secured between nuts 30 and 32 lies essentially in a plane that passes through the axis of tablet rail 18. The spring 26 is preferably formed of phosphor-bronze, is about one-half inch wide and has a thickness of the order of 0.020 inch. The spring is preformed to have a slight curvature over that portion between the point of attachment to stud 28 and the point at which it approaches the under surface of the tablet 10, and to have a sharper curvature at its upper end to substantially conform to the curved under side 34 of the tablet. Typically, the radius of curvature of the curved portion 34 is 9/32 inch. A thin strip of cushioning material, such as a strip 36 of felt is adhesively joined to the curved under side 34 of the tablet to ensure smoothness and quietness of relative movement between the spring and the tablet as the tablet is pivoted about the rail 18. The described and illustrated spring properties are such as to urge the bottom of the groove 12 upwardly against the rod 18 and to maintain the tablet 10 in a predetermined neutral position, namely, the position shown in FIGS. 1 and 2. If all of the tablets and springs are manufactured to the same tolerance, which is relatively easy to accomplish, and are assembled in the same way, the tablets all assume the same neutral position and give the array of stop tablets an even and neat appearance.

When the tablet is depressed from its neutral position as shown in FIG. 3, a protuberance 38 at the inner extremity of the curved surface 34 engages the spring 26 at a point inwardly from its free end and causes it to bend at a point somewhat above the point of attachment so as to have a curvature substantially as illustrated. When downward pressure on the tablet is released, the spring returns to its original shape and in so doing returns the tablet 10 to its neutral position. When the tablet is moved upwardly from its neutral position as illustrated in FIG. 4, the outer extremity of the curved surface 34 engages spring 26 at a point relatively close to the free end and tends to bend the spring to have a sharper radius of curvature than when in its neutral position. Again, when upward pressure on the tablet is released, the spring returns to its predetermined shape and returns the tablet to its neutral position. The spring 26 is sufficiently stiff to give a "positive " feel to the tablet operation, and to return and maintain the tablet in its predetermined neutral position with a fair degree of firmness.

As best seen in FIG. 1, the upper surface of that end of the tablet 10 having the curved under-side 34 is formed to receive a contactor wire 40, which is secured to the tablet by a screw 42. The wire is shaped to have a U-shaped end under the head of the screw and to extend rearwardly to be engaged in a longitudinal groove 44 formed in the lips 14 and 16, and is bent to provide a portion at its free end disposed substantially parallel to the tablet rail 18. When a tablet is depressed from its neutral position, the free end of wire 40 moves upwardly, and when the tab is moved upwardly from the neutral position the wire 40 moves downwardly. The shaped wire 40 constitutes a movable contactor which engages a first fixed contact 46 when the tablet is depressed and engages a second fixed contact 48 when the tablet is moving upwardly from its netural position. Typically, the contacts 46 and 48 take the form of small closed coil springs, two pairs of which are shown in FIG. 1, supported on an insulative panel 50 and connected to respective solder lugs 52 and 54 to facilitate connection to latching circuitry of the kind described in the aforementioned co-pending application, or to other circuitry for enabling and disabling the stop associated with a given tablet.

While a particular embodiment of the invention has been illustrated and described, it will now be apparent to those skilled in the art that changes and modifications may be made without departing from the invention in its broader aspects. For example, the dimensions of the springs 26 and their material may be other than as described, the felt strip 36 may be adhesively attached to the spring instead of to the tablet, and the tablet and bracket construction may differ in details. It is the intention in the appended claims to cover all such changes and modifications as fall within the true spirit of the invention.

We claim:

1. A stop tablet mechanism for electronic organs or the like, comprising, a supporting bracket having a plurality of parallel spaced-apart elongated flanges, each having an opening therethrough substantially aligned with the openings in the others, and having a plurality of attaching means positioned one each between adjacent ones of said flanges and spaced from the alignment axis of the openings in said flanges, an elongated rod received and supported in the openings in said flanges, a plurality of elongated stop tablets each having upper and under surfaces, one positioned between each adjacent pair of said flanges, and each having a transverse groove in its upper surface near one end thereof engaging said elongated rod for pivotal movement thereabout, and having a curved portion on its under surface extending from said one end to a point substantially opposite said groove, and a plurality of elongated flat springs, one for each of said stop tablets, each secured at one end to a respective one of said attaching means with said one end lying substantially in a plane including said elongated rod, its other end being free and engaging the said curved portion of the under surface of said stop tablet, that portion of the spring engaging the stop tablet having a radius of curvature substantially conforming to said curved portion of the tablet thereby to urge the bottom of said groove into engagement with said elongated rod and to maintain said stop tablet in a predetermined neutral position, and operative to return the stop tablet to said neutral position from alternate positions of use displaced from said neutral position.

2. The stop tablet mechanism according to claim 1, further including cushion material disposed between said curved portion of the under surface of the stop tablet and that portion of the spring engaging the stop tablet.

3. The stop tablet mechanism according to claim 2, wherein said cushion is a strip of felt adhesively secured to said curved portion of the stop tablet.

4. The stop tablet mechanism according to claim 1, wherein said curved portion of the under surface of the stop tablet is shaped to cause the outer extremity of the said curved surface to engage said spring near the free end thereof when said stop tablet is operated to one of said alternate positions of use, and to cause the inner extremity thereof to engage said spring at a point inwardly from the free end thereof and to bend the spring in the same direction but with a different curvature when the stop tablet is operated to the other of said alternate positions of use.

5. The stop tablet mechanism according to claim 1, wherein said flat springs are formed of phosphor-bronze and are dimensioned to be sufficiently stiff to relatively firmly maintain the stop tablets in their predetermined neutral position.

* * * * *